US006775491B2

(12) United States Patent
Akutsu et al.

(10) Patent No.: US 6,775,491 B2
(45) Date of Patent: Aug. 10, 2004

(54) FIXING UNIT

(75) Inventors: Naoji Akutsu, Tokyo (JP); Akinori Kumonaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/448,845

(22) Filed: May 30, 2003

(65) Prior Publication Data

US 2003/0206745 A1 Nov. 6, 2003

Related U.S. Application Data

(63) Continuation of application No. 10/153,534, filed on May 21, 2002, now Pat. No. 6,597,879.

(30) Foreign Application Priority Data

Jul. 5, 2001 (JP) ..... 2001-204726

(51) Int. Cl.[7] ..... G03G 15/20

(52) U.S. Cl. ..... 399/69; 219/216; 219/470; 399/33

(58) Field of Search ..... 399/33, 67, 69, 399/320, 328, 329, 335; 219/216, 469, 470, 619

(56) References Cited

U.S. PATENT DOCUMENTS 4,714,819 A * 12/1987 Yamashita ..... 219/216
4,801,974 A * 1/1989 Suto et al. ..... 399/33
5,041,718 A 8/1991 d'Hondt et al.
5,787,319 A * 7/1998 Tomatsu ..... 399/33
5,828,035 A * 10/1998 Kuroda ..... 219/216
6,097,904 A 8/2000 Tsuruno et al.
6,292,647 B1 9/2001 Ishida
6,301,454 B1 10/2001 Nishida et al.
6,333,490 B1 12/2001 Higashi et al.
6,597,879 B2 * 7/2003 Akutsu et al. ..... 399/69
2002/0043523 A1 4/2002 Fujita et al.

FOREIGN PATENT DOCUMENTS

JP 08-110732 A 4/1996
JP 11-316517 A 11/1999

* cited by examiner

*Primary Examiner*—Sandra L. Brase
(74) *Attorney, Agent, or Firm*—Akin Gump Strauss Hauer & Feld, LLP

(57) ABSTRACT

A fixing unit fixes a developing material deposited on a recording medium by heating and pressing the recording medium. The fixing unit includes two heating members that apply heat to the recording medium and two temperature-sensitive shutoff devices. The two temperature-sensitive shutoff devices are connected in series with a corresponding one of the heating members. Each of the temperature-sensitive shut-off devices includes a first heat-sensitive shut-off element and a second heat-sensitive shut-off element. The first heat-sensitive shut-off element shuts off electric power to the corresponding one of the two heating members when a temperature of a surface of the corresponding one of the two heating members exceeds a certain value. The second heat-sensitive shut-off element shuts off electric power to the corresponding one of the two heating members when a temperature of a surface of the second one of the two heating members exceeds a certain value.

10 Claims, 4 Drawing Sheets

FIXING UNIT

CROSS REFERENCE TO RELATED APPLICATIONS

This application is a continuation of copending U.S. application Ser. No. 10/153,534, filed May 21, 2002, now U.S. Pat. 6,597,879 entitled "FIXING UNIT," the entire disclosure of which is incorporated herein by reference.

BACKGROUND OF THE INVENTION

1. Field of the Invention

The present invention relates to a fixing unit incorporated in an electrophotographic recording apparatus, and more particularly to a fixing unit where the developer material deposited on a print medium is pressed and heated to fuse.

2. Description of the Related Art

A conventional fixing unit for use in an electrophotographic printer includes a rotating heat roller and a rotating backup roller. The surfaces of the heat roller and backup roller have a rubber material or a resin material wrapping around them. The heat roller is cylindrical and has a built-in heater in the form of, for example, a halogen lamp. Electric power is supplied to the heater, which in turn generates heat to heat the heat roller to a desired temperature.

The heat roller has a temperature sensor in the form of a thermistor. The temperature sensor detects the temperature of the surface of the heat roller. The detection signal causes a control circuit to turn on and off the electric power supplied to the halogen lamp, thereby maintaining the surface temperature of the heat roller to a substantially constant value. For safety of the system, there is provided a thermostat that shuts off electric power when the feedback control operates abnormally to overheat the heat roller. The thermostat shuts off the electric power before the temperature of the heat roller exceeds a maximum allowable value, thereby preventing an abnormal increase in temperature.

FIG. 6 illustrates another conventional fixing unit. Referring to FIG. 6, instead of a heat roller and a backup roller, a fixing unit 1 uses two heat rollers 2 and 3 that heat a print medium both from the front side and from the back side simultaneously. This type of fixing unit is advantageous when the printing speed of the electrophotographic printer is to be increased. The recording medium passes through the fixing unit at a high speed and therefore heat rollers must apply a sufficient amount of heat to the printing medium in a short time during which the printing medium passes through the fixing unit.

There are provided thermistor sensors 4 and 5 on the heat rollers 2 and 3, respectively. The thermistor sensors 4 and 5 are connected to control circuits 8 and 9 through connectors 6 and 7, respectively. The control circuits 8 and 9 are connected to an a-c main line 12 through thyristors 10 and 11.

Thermostats 13 and 14 are disposed on the surfaces of the heat rollers 2 and 3, respectively. The thermostat 13 has one cord connected to a halogen lamp 15 in the heat roller 2 and the other cord connected to the a-c main line 12 through a fuse 16 and the connector 6. Likewise, the thermostat 14 has one cord connected to a halogen lamp 17 in the heat rollers 3 and the other cord connected to the AC main line 12 through the fuse 16.

FIG. 7 is a graph that illustrates changes in the surface temperature of the heat rollers in the conventional art when temperature control fails. Curve A indicates the surface temperature of the heat roller 22 when temperature control fails and Curve B shows the surface temperature of the heat roller 23 when temperature control operates normally.

The operation of the conventional fixing unit of the aforementioned construction will be described. If the temperature control involving one of the thermistor sensors 4 and 5 should fail and a heat roller in a failed control system is overheated, a corresponding thermostat operates to shut off the circuit before the temperature reaches a tolerable value. The temperature of the heat roller 23 under abnormal temperature control will start to decrease. The heat roller 22 under normal temperature control maintains its surface temperature substantially at the target value. Therefore, as shown by Curve A, the temperature of the heat roller 23 will not decrease rapidly but slowly reach the target value at time t3.

With the aforementioned conventional fixing unit that employs two heat rollers, the thermostats are connected to separate circuits. If one of the feedback control systems fails, a corresponding thermostat in the failed system is shut off. A thermostat in the normally operating system is not shut off but performs its on and off operation under the control of the output of a corresponding thermistor. In other words, the surface of a normally operating heat roller is maintained at a desired temperature. The temperature of an abnormally operating heat roller will not decrease and the abnormal condition will remain for a long time.

SUMMARY OF THE INVENTION

An object of the invention is to provide a fixing unit in which when a heat roller is overheated due to an abnormal condition, the abnormal condition is prevented from lasting for a long time.

A fixing unit fixes a developing material deposited on a recording medium by heating and pressing the recording medium. The fixing unit includes two heating members that apply heat to the recording medium and two temperature-sensitive shutoff devices. The two temperature-sensitive shutoff devices are connected in series with a corresponding one of the heating members. Each of the temperature-sensitive shut-off devices includes a first heat-sensitive shut-off element and a second heat-sensitive shut-off element. The first heat-sensitive shut-off element shuts off electric power to the corresponding one of the two heating members when a temperature of a surface of the corresponding one of the two heating members exceeds a certain value. The second heat-sensitive shut-off element shuts off electric power to the corresponding one of the two heating members when a temperature of a surface of the second one of the two heating members exceeds a certain value.

A fixing unit fixes a developing material deposited on a recording medium by heating and pressing the recording medium. The fixing unit includes a first number of heating members that apply heat to the recording medium and a second number of temperature-sensitive shut-off devices in series with each one of the first number of heating members. Each of the first number of heating elements receives electric power through a series connection of the second number of switches. The second number of temperature-sensitive shut-off devices operates in such a way that each of the first number of heating elements receives electric power through the series connection of the second number of temperature-sensitive shut-off devices. Each of the second number of temperature-sensitive shut-off devices receives heat from a surface of a corresponding one of the first number of heating members to turn off the electric power in response to a temperature of the surface.

A fixing unit fixes a developing material deposited on a recording medium by heating and pressing the recording medium. The fixing unit includes a first number of heating members that apply heat to the recording medium and a second number of switches. Each of the first number of heating members receives electric power through a series circuit of the second number of switches. Each of the second number of switches responds to a surface temperature of a corresponding one of the first number of heating members so that when the surface temperature exceeds a predetermined value, the electric power is shut off.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

First Embodiment

Figure 1:
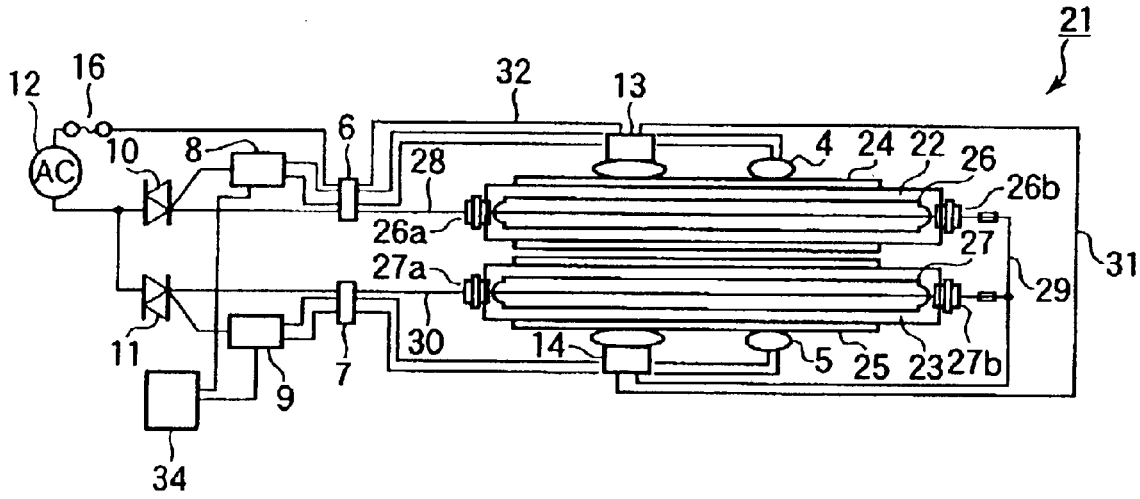
FIG. 1 is a schematic diagram, illustrating a fixing unit according to a first embodiment of the invention.

FIG. 1 is a schematic diagram, illustrating a fixing unit according to a first embodiment of the invention.

Referring to FIG. 1, a fixing unit 21 includes two heat rollers 22 and 23. The surfaces 24 and 25 of the heat rollers 22 and 23 are covered with a layer of a rubber material or a resin material. Halogen lamps 26 and 27 are disposed in the heat rollers 22 and 23, respectively, and serve as a heater. The halogen lamp 26 has one end 26*a* connected to a cord 28 and the other end 26*b* connected to a cord 29. The halogen lamp 27 has one end 27*a* connected to a cord 30 and the other end 27*b* connected to the cord 29.

Thermistor sensors 4 and 5 are disposed on the heat rollers 22 and 23, respectively, and connected to control circuits 8 and 9 through connectors 6 and 7, respectively.

Thermostats 13 and 14 are disposed on the surfaces of the heat rollers 22 and 23. The thermostats 13 and 14 take the form of an overtemperature thermostat.

The cord 28 connects the halogen lamp 26 and a cathode of a thyristor 10 through a connector 6. An anode of the thyristor 10 is connected to one of the terminals of an a-c main line 12. The cord 30 connects the halogen lamp 27 and the cathode of a thyristor 11 through a connector 7. The anode of the thyristor 11 is connected to one of the terminals of the a-c main line 12. The cord 32 connects the thermostat 13 to the main line 12 through the connector 6 and fuse 16. The thermostat 14 is connected to the halogen lamps 26 and 27 through the cord 29. The thermostat 14 is also connected to the thermostat 13 through the cord 31. The aforementioned circuit connection completes a series connection between the thermostat 13 and thermostat 14.

Temperature-controlling circuits 8 and 9 are connected to a temperature-setting circuit 34 and to gates of the thyristors 10 and 11. The temperature-setting circuit 34 sends a command to the temperature-controlling circuits 8 and 9 to control the temperatures of the heat rollers 22 and 23, respectively.

The operation of the first embodiment will be described. When the printer is powered on and a printing operation is initiated, the temperature-setting circuit 34 sends a temperature-setting command to the temperature-controlling circuits 8 and 9 to set the surfaces of the heat rollers 22 and 23 to a target temperature. The temperature-controlling circuit 8 compares a detection signal from the thermistor sensor 4 with a target temperature. If the detection signal is lower than the target temperature, then the temperature-controlling circuit 8 provides a signal to the gate of the thyristor 10 to turn on the thyristor 10. Then, the thyristor 10 allows a-c current to flow therethrough, the a-c current flowing through the cord 28 into the halogen lamp 26 to heat the heat roller 22.

The thermistor 4 monitors the surface temperature of the heat roller 22. If the temperature monitored by the thermistor 4 exceeds a threshold value, then the temperature-controlling circuit 8 provides a signal to the gate of the thyristor 10, thereby turning off the thyristor 10. In response to the signal, the thyristor 10 shuts off the a-c current flowing through it, so that no current flows through the halogen lamp 26 and therefore the heat roller 22 begins to cool down. If the surface temperature of the heat roller 22 decreases below the threshold value, the aforementioned operation is performed so that current flows through the halogen lamp 26 again. By repeating the aforementioned operation, the surface temperature of the heat roller 22 is maintained substantially to a target temperature.

A similar temperature control is performed for the heat roller 23. That is, the temperature-controlling circuit 9 compares a detection signal from the thermistor sensor 5 with a target temperature received from the temperature-setting circuit 34. The comparison result is used to drive the thyristor 11 to control the current flowing through the halogen lamp 27, so that the surface temperature of the heat roller 23 is maintained substantially to the target temperature.

During normal operation, the a-c currents flowing out of the halogen lamps 26 and 27 are added together at the terminal of the thermostat 14 and then further flows through the thermostat 13, connected in series with the thermostat 14, to the fuse 16.

If the feedback control through the thermistor sensors 4 and 5 should fail so that the halogen lamps 26 and 27 are overheated, the thermostat in the circuit having an overheated halogen lamp operates to shut off the electric power supplied thereto. For example, if a foreign matter is caught between the thermistor sensor 4 and the heat roller 22, the foreign matter prevents the thermistor sensor 4 from detecting the surface temperature of the heat roller 22 properly. As a result, a large current flows through the halogen lamp 26 and may cause the surface temperature of the heat roller 22 to exceed a target value.

When the surface of the heat roller 22 exceeds the upper limit temperature, the thermostat 13 operates to shut off the current flowing through the halogen lamp 26. Therefore, the current flowing through the halogen lamp 27 is also shut off. Shutting off the current that flows through the halogen lamps 26 and 27 causes the surface temperature of the heat rollers 22 and 23 to rapidly decrease.

Figure 2:
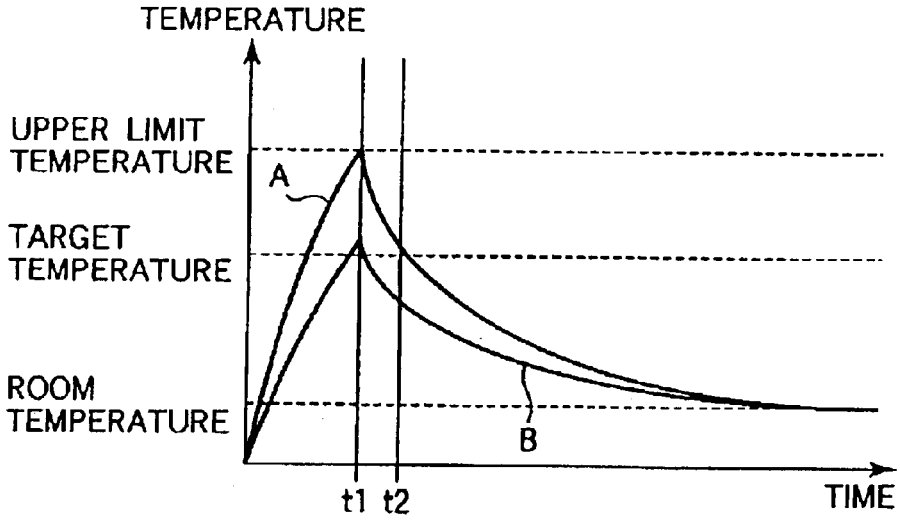
FIG. 2 is a graph that illustrates changes in the surface temperature of the heat roller in the first embodiment.

FIG. 2 is a graph that illustrates changes in the surface temperature of the heat roller in the first embodiment.

Figure 7:
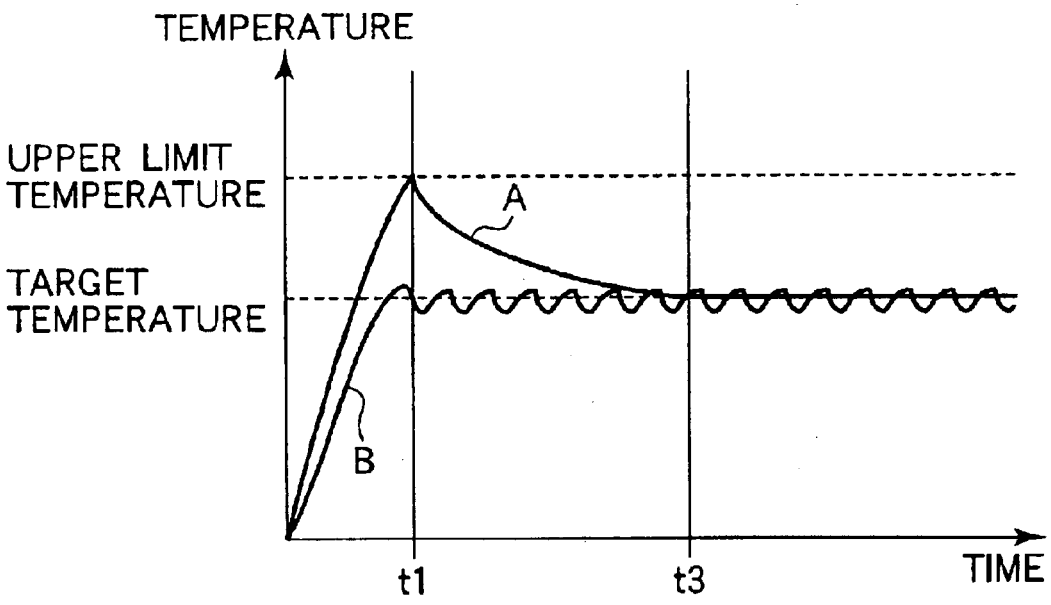
FIG.7 CONVENTIONAL ART
FIG. 7 is a graph that illustrates changes in the surface temperature of the heat roller in the conventional fixing unit when temperature control fails.

Referring to FIG. 2, Curve A indicates the surface temperature of the heat roller 22 and Curve B shows the surface temperature of the heat roller 23. Upper limit temperature is a temperature beyond which the thermostat 13 operates to shut off the current through the circuit and target temperature is a temperature value toward which the surface temperatures of the heat rollers 22 and 23 are controlled. As shown in FIG. 2, when the surface temperature of the heat roller 22 increases to the upper limit temperature at time t1, the thermostat 13 operates to shut off the current through it, as well as the current flowing through the halogen lamp 27 in the heat roller 23. Thus, the surface temperature of the heat roller 23 also decreases. The decrease in the surface temperature of the heat roller 23 allows the surface temperature of the heat roller 22 to decrease promptly. In fact, the time required for the heat roller 22 to cool down to the target temperature is t2 in FIG. 2, shorter than t3 in FIG. 7. As described previously, the thermostats 13 and 14 take the form of an overtemperature thermostat. That is, the thermostat opens at, for example, 150° C. and closes at, for example, below 0° C. Thus, once the thermostat opens at a high abnormal temperature, the circuit will remain open after the heat rollers cool down to room temperature. The use of an overtemperature thermostat enhances safety of the apparatus. A thermal fuse may be used in place of the overtemperature thermostat.

As described above, the thermostats 13 and 14 are connected in series with a parallel circuit of the halogen lamps 26 and 27. Therefore, when a failure of the temperature control for one of the heat rollers 22 and 23 causes a corresponding heat roller to be overheated, a corresponding thermostat operates to shut off the current flowing through the halogen lamps 26 and 27. This makes an abnormal condition to quickly terminate, thereby improving safety of the fixing unit 21.

Second Embodiment

While the first embodiment has been described with respect to a fixing unit having two heat rollers, more heat rollers may be employed. A second embodiment differs from the first embodiment in that the fixing unit uses three heat rollers.

Figure 3:
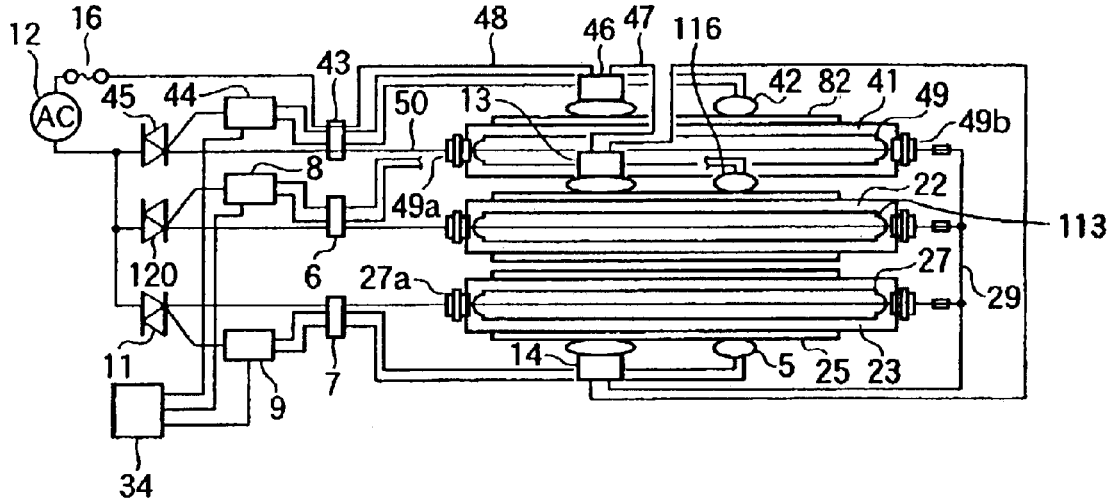
FIG. 3 is a schematic diagram, illustrating a fixing unit according to a second embodiment.

FIG. 3 is a schematic diagram, illustrating a fixing unit according to the second embodiment.

Figure 4:
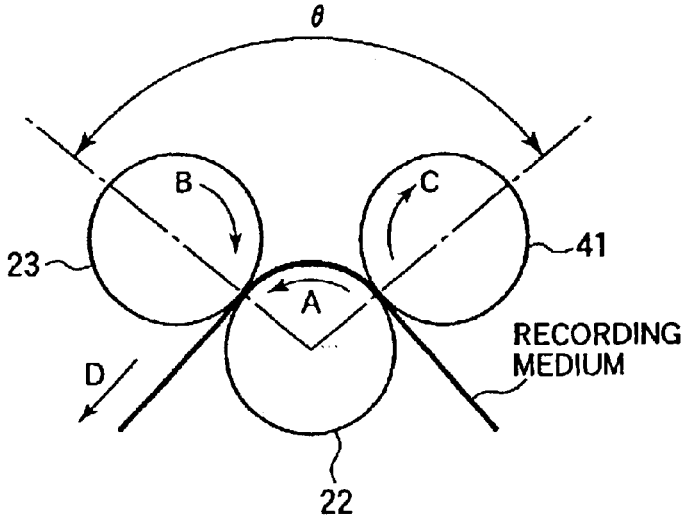
FIG. 4 is a cross-sectional view of the fixing unit of FIG. 3.

FIG. 4 is a cross-sectional view of the fixing unit of FIG. 3.

Referring to FIG. 3, a heat roller 41 is in contact with the heat roller 22. A thermistor sensor 42 is disposed on a surface 82 of the heat roller 41. The thermistor sensor 42 is electrically connected through a connector 43 to a temperature-controlling circuit 44. A thermistor sensor 116 is disposed on the surface of the heat roller 22. The thermistor 116 is electrically connected through a connector 6 to a temperature-controlling circuit 8. The temperature-controlling circuit 44 is connected to the gate of a thyristor 45 and the temperature-setting circuit 34.

A thermostat 46 is disposed on the surface 82 of the heat roller 41. A cord 47 connects the thermostat 46 to the thermostat 13, and a cord 48 connects the thermostat 46 to the a-c main line 12 through the connector 43 and the fuse 16.

A halogen lamp 49 has one end 49*b* thereof connected to one terminal of the thermostat 14 through a cord 29, and the other end 49*a* thereof connected to the cathode of the thyristor 45 through a cord 50 and the connector 43. The anode of the thyristor 45 is connected to the another terminal of the a-c main line 12. The rest of the construction is the same as the first embodiment.

Referring to FIG. 4, the heat rollers 22, 23, and 41 rotate in directions shown by arrows A, B, and C and the recording medium travels in a direction shown by arrow D. The positional relation between rollers 23 and 41 and the roller 22 may be interchanged so that the recording medium travels upward after it passes through between the roller 23 and the roller 22. An angle θ and the diameters of the rollers can be selected by considering the flexibility of the recording medium. This type of fixing unit is advantageous when high-speed printing is performed. When the recording medium passes through the fixing unit at a high speed, the recording medium cannot receive a sufficient amount of heat. The configuration of FIG. 4 effectively increases the time during which the recording medium is subjected to heating. The recording medium is guided by a guide member, not shown, that extends substantially through the angle θ in such a way that the recording medium passes between the heat roller 22 and heat roller 41 and then between the heat roller 22 and heat roller 23.

When an abnormal condition occurs in any one of the three heat rollers 41, 22, and 23, the current flowing through the halogen lamps 49, 113, and 27 in all other heat rollers is shut off, thereby preventing the abnormal condition from lasting for a long time. The second embodiment has been described with respect to three rollers 22, 23, and 41 rotate in contact with the recording medium. An additional heat roller may be combined to these heat rollers 22, 23, and 41 so that the additional heat roller rotates in contact with one of the three rollers 22, 23, and 41, and heats the recording medium indirectly.

Third Embodiment

Figure 5:
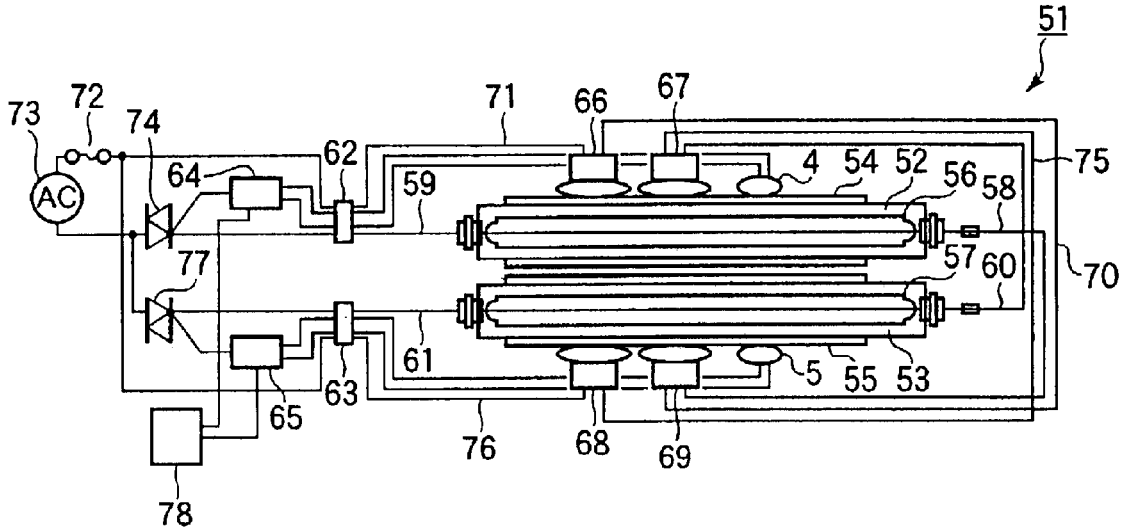
FIG. 5 illustrates a fixing unit according to a third embodiment.
Figure 6:
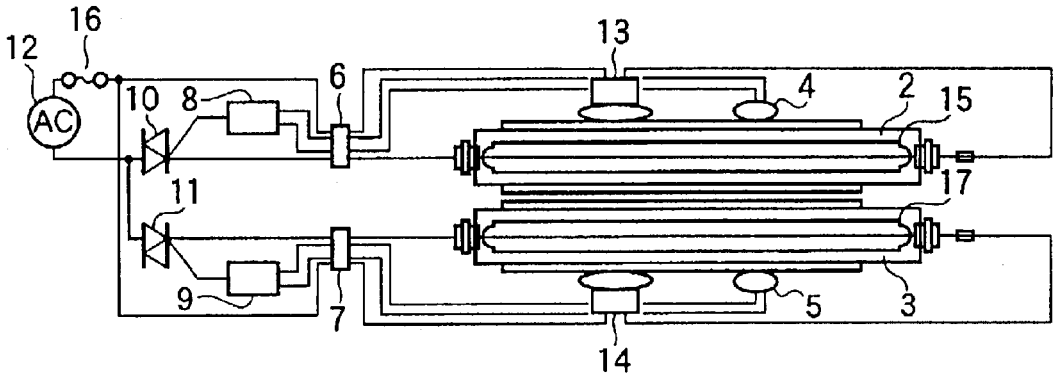
FIG.6 CONVENTIONAL ART
FIG. 6 illustrates a conventional fixing unit.

FIG. 5 illustrates a fixing unit according to a third embodiment.

With the first and second embodiments, the thermostats are simply connected in series regardless of the number of heat rollers. The third embodiment differs from the first and second embodiments in that there are as many series-connections of thermostats as there are heat rollers.

Referring to FIG. 5, a fixing unit 51 according to the third embodiment includes two heat rollers 52 and 53. The heat rollers have surfaces 54 and 55, respectively, which are covered with a rubber material or a resin material. The heat rollers 52 and 53 have halogen lamps 56 and 57 built therein, respectively. The halogen lamps 56 and 57 have one ends thereof connected to cords 58 and 59 and the other ends thereof connected to cords 60 and 61.

There are provided the thermistor sensors 4 and 5 on the surface of the heat rollers 52 and 53, respectively. The thermistor sensors 4 and 5 are connected to temperature-controlling circuits 64 and 65 through connectors 62 and 63, respectively. Thermostats 66 and 67 are disposed on the surface of the heat roller 52, and thermostats 68 and 69 are disposed on the heat roller 53.

A first series circuit is formed as follows: A cord 58 connects the halogen lamp 56 in the heat roller 52 to the thermostat 69 on the heat roller 53. A cord 70 connects the thermostat 69 to the thermostat 66 on the heat roller 52. A cord 71 connects the thermostat 66 to an a-c main line 73 through the connector 62 and a fuse 72. The cord 59 connects a cathode of a thyristor 74 through the connector 62 to the halogen lamp 56. The thyristor 74 has an anode connected to the a-c main line 73.

Another series circuit is formed as follows: A cord 60 connects the halogen lamp 57 in the heat roller 53 to the thermostat 67 on the heat roller 52. A cord 75 connects the thermostat 67 to the thermostat 68 on the heat roller 53. A cord 76 connects the thermostat 68 to the a-c main line 73 through the connector 63 and the fuse 72. A thyristor 77 has a cathode connected through the cord 61 and the connector 63 to the halogen lamp 57, and an anode connected to the a-c supply 73.

The current that flows through the thermostats 66 and 69 is equal to the current that flows through the halogen lamp 56. The current that flows through the thermostats 67 and 68 is equal to the current that flows through the halogen lamp 57.

The thermostats 66 and 67 disposed on the heat roller 52 are designed to operate at substantially the same temperature. Likewise, the thermostats 68 and 69 disposed on the heat roller 53 are designed to operate at substantially the same temperature.

The temperature controlling circuits 64 and 65 are connected to a temperature-setting circuit 78 and gates of the thyristors 74 an 77. The temperature-setting circuit 78 provides a command signal to the temperature-controlling circuits 64 and 65 to perform the temperature control for the heat rollers 52 and 53.

The operation of the third embodiment will now be described. In response to the command signal from the temperature-setting circuit 78, the temperature-controlling circuit 64 sends an ON signal to the thyristor 74. The thyristor 74 then operates to allow an a-c current to flow through the halogen lamp 56 in the heat roller 52. The current that flows through the halogen lamp 56 also flows through the thermostat 69 on the heat roller 53, then through the thermostat 66 on the heat roller 52, and finally returns to the a-c main line 73 through the connector 62 and fuse 72.

In response to the command signal from the temperature-setting circuit 78, the temperature-controlling circuit 65 sends an ON signal to the thyristor 77. The thyristor 77 then operates to allow an a-c current to flow through the halogen lamp 57 in the heat roller 53. The current that flows through the halogen lamp 57 also flows through the thermostat 67 on the heat roller 52, then the thermostat 68 on the heat roller 52, and finally returns to the a-c main line 73 through the connector 63 and fuse 72.

If the feedback control through one of the thermistor sensors should fail to properly operate and a corresponding heat roller is overheated, the thermostat on the overheated heat roller operates to shut off electric power through it. For example, when the heat roller 52 is overheated, the thermostats 66 and 67 operate simultaneously or substantially simultaneously to shut off the current flowing through the halogen lamps 56 and 57. Likewise, when the heat roller 53 is overheated, the thermostats 68 and 69 operate simultaneously or substantially simultaneously to shut off the current flowing through the halogen lamps 56 and 57.

For example, if a foreign material is trapped between the thermistor 4 and the heat roller 52, the foreign matter prevents the thermistor sensor 4 from detecting the surface temperature of the heat roller 52 properly. As a result, a large current flows through the halogen lamp 56 and may cause the surface temperature of the heat roller 52 to exceed the upper limit temperature.

If the surface temperature of the heat roller 52 exceeds the upper limit temperature, the thermostats 66 and 67 operate. In other words, the thermostat 66 shuts off the current flowing through the halogen lamp 56 while the thermostat 67 shuts off the current flowing through the halogen lamp 57. Shutting off the currents that flow through the halogen lamps 56 and 57 allows the heat rollers 52 and 53 to cool down rapidly.

According to the third embodiment, when the temperature control for one of a plurality of heat rollers fails and causes the associated heat roller to be overheated, the system operates to shut off not only the current flowing through the halogen lamp for the heat roller under failed temperature control but also the current flowing through the other halogen lamps for the heat rollers under normal temperature control. This way of operation prevents the abnormal condition from lasting a long time and improves safety of the system.

The circuit is configured in such a way that the current that flows through the respective thermostats is equal to the current for one halogen lamp. This allows employing inexpensive thermostats having a low current rating.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fixing unit that fixes a developing material deposited on a recording medium by heating and pressing the recording medium, comprising:

two heating members that apply heat to the recording medium; and two temperature-sensitive shut-off devices each of which is connected in series with a corresponding one of the two heating members;

wherein each of the two temperature-sensitive shut-off devices includes a first heat-sensitive shut-off element and a second heat-sensitive shut-off element, the first heat-sensitive shut-off element shutting off electric power to the corresponding one of the two heating members when a temperature of surface of the corresponding one of the two heating members exceeds a predetermined value, the second heat-sensitive shut-off element shutting off electric power to the corresponding one of the two heating members when a temperature of a surface of the second one of the two heating members exceeds a predetermined value.

2. The fixing unit according to claim 1, wherein the two heating members and the two temperature-sensitive shut-off devices form two series connections, wherein each of the two series connections is a series connection of one of the two heating members and one of the two temperature-sensitive shut-off devices, the two series connections being connected in parallel with an electric power source.

3. The fixing unit according to claim 1, wherein the temperature-sensitive shut-off devices are overtemperature thermostats.

4. The fixing unit according to claim 1, wherein the temperature-sensitive shut-off devices are thermal fuses.

5. A fixing unit that fixes a developing material deposited on a recording medium by heating and pressing the recording medium, comprising:

and a first number of heating members that apply heat to the recording medium;

a second number of temperature-sensitive shut-off devices in series with each one of the first number of heating members;

wherein each of the first number of heating members receives electric power through a series connection, the second number of temperature-sensitive shut-off advices operating in such a way that each of the first number of heating members receives electric power through the series connection of the second number of temperature-sensitive shut-off devices, each of the second number of temperature-sensitive shut-off devices receiving heat from surface of a corresponding one of the first number of heating members to turn off the electric tower in response to a temperature of the surface.

6. The fixing unit according to claim 5, wherein the first number of heating members include two heating members and the second number of temperature-sensitive shut-off devices include two temperature-sensitive shut-off devices.

7. The fixing unit according to claim 6, wherein the two heating members and the two temperature-sensitive shut-off devices form two series connections, wherein each of the two series connections is a series connection of one of the two heating members and the two temperature-sensitive shut-off device, the two series connections being connected in parallel with an electric power source.

8. The fixing unit according to claim 5, wherein the temperature-sensitive shut-off devices are overtemperature thermostats.

9. The fixing unit according to claim 5, wherein the temperature-sensitive shut-off devices are thermal fuses.

10. A fixing unit that fixes a developing material deposited on a recording medium by heating and pressing the recording medium, comprising:

a first number of heating members that apply heat to the recording medium;

a second number of temperature-sensitive shut-off devices; and wherein each of the first number of heating members receives electric power through a series circuit, each of the second number of temperature-sensitive shut-off devices responding to a surface temperature of a corresponding one of the first number of heating members so that when the surface temperature exceeds a predetermined value, the electric power is shut off.

* * * * *